US008336331B2

(12) United States Patent
Kim

(10) Patent No.: US 8,336,331 B2
(45) Date of Patent: Dec. 25, 2012

(54) REFRIGERATOR

(75) Inventor: Hyeong-Il Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 813 days.

(21) Appl. No.: 12/300,313

(22) PCT Filed: Jul. 12, 2007

(86) PCT No.: PCT/KR2007/003393

§ 371 (c)(1),
(2), (4) Date: Aug. 4, 2009

(87) PCT Pub. No.: WO2008/007916

PCT Pub. Date: Jan. 17, 2008

(65) Prior Publication Data

US 2010/0043479 A1 Feb. 25, 2010

(30) Foreign Application Priority Data

Jul. 12, 2006 (KR) ..... 10-2006-0065584

(51) Int. Cl.
*F25D 11/02* (2006.01)
*A47B 96/04* (2006.01)

(52) U.S. Cl. ..... 62/446; 312/405

(58) Field of Classification Search ..... 62/320, 62/344, 377, 389, 449, 337–338, 340
See application file for complete search history.

(56) References Cited

U.S. PATENT DOCUMENTS

| | | | | |
|---|---|---|---|---|
| 2,126,491 | A * | 8/1938 | McCartha | 222/182 |
| 2,408,704 | A * | 10/1946 | Taylor | 222/160 |
| 3,851,939 | A * | 12/1974 | Benasutti et al. | 312/139.2 |
| 6,964,177 | B2 | 11/2005 | Lee et al. | |
| 7,007,500 | B2 * | 3/2006 | Lee | 62/389 |
| 7,059,693 | B2 * | 6/2006 | Park | 312/405.1 |
| 2003/0132690 | A1 * | 7/2003 | Shin et al. | 312/405 |
| 2004/0178710 | A1 * | 9/2004 | Kim et al. | 312/405 |
| 2004/0237565 | A1 | 12/2004 | Lee et al. | |
| 2005/0072178 | A1 * | 4/2005 | Park et al. | 62/389 |
| 2005/0144970 | A1 * | 7/2005 | Cho et al. | 62/441 |
| 2005/0229623 | A1 * | 10/2005 | Kim | 62/389 |
| 2006/0144075 | A1 * | 7/2006 | Bowen et al. | 62/344 |
| 2006/0218961 | A1 | 10/2006 | Kim et al. | |

FOREIGN PATENT DOCUMENTS

| | | | |
|---|---|---|---|
| CN | 1690618 | A | 11/2005 |
| KR | 10-2004-0042746 | A | 5/2004 |
| KR | 10-2004-0102571 | A | 12/2004 |
| KR | 10-2005-0034422 | A | 4/2005 |
| KR | 10-2005-0071221 | A | 7/2005 |
| KR | 10-2006-0094700 | A | 8/2006 |
| WO | WO-2004/085937 | A1 | 10/2004 |

* cited by examiner

*Primary Examiner* — Frantz Jules
*Assistant Examiner* — Emmanuel Duke
(74) *Attorney, Agent, or Firm* — Birch, Stewart, Kolasch & Birch, LLP

(57) ABSTRACT

Provided is a refrigerator. More functions can be added to a refrigerator door by coupling a home bar and a dispenser. Also, since the dispenser is disposed so that it is shielded from the outside, contamination of the dispenser can be prevented.

6 Claims, 4 Drawing Sheets

REFRIGERATOR

TECHNICAL FIELD

The present disclosure relates to a refrigerator and a controlling method thereof.

BACKGROUND ART

Generally, a refrigerator is an apparatus for storing food at low temperature using a refrigerant cycle.

A refrigerator main body includes a cooling chamber and a freezing chamber. The cooling chamber and the freezing chamber are opened/closed by a cooling chamber door and a freezing chamber door, respectively.

A dispenser is provided to the cooling chamber door or the freezing chamber door. The dispenser is a unit for allowing water to be drained without opening the door. A water tank is connected to the dispenser. The dispenser is provided with a lever allowing a user to drain water while the user presses the lever.

Also, a home bar is provided to the front side of a door where the dispenser is not disposed. The home bar is a unit for allowing a user to put out food such as drinking water to the outside without opening a door. The home bar is selectively opened/closed using a home bar door. The home bar door is installed such that its upper end is vertically rotatable around its lower end.

However, a related art refrigerator has the following limitations.

Since the dispenser and the home bar should be disposed at appropriate heights for use convenience or preference, they have been disposed at different doors of a predetermined height. For example, the dispenser is disposed at a predetermined height of a cooling chamber door, and the home bar is disposed at a freezing chamber door of the same height as that of the dispenser. Therefore, only some of the dispenser, the home bar, a display panel, and a television are inevitably and selectively disposed at a predetermined height of the door. Also, there is a limit in adding a function desired by a user to the refrigerator. Also, even when all of the above-described functions are added to the door of the refrigerator, the front appearance of the refrigerator is complicated, which makes it difficult to realize a simple design.

Also, in the case where the dispenser and the home bar are disposed at a predetermined height of the door, they are inevitably disposed at different doors, respectively.

Also, since a discharge port of the dispenser is always exposed to the outside, the discharge port of the dispenser may be contaminated by dusts.

Since the dispenser and the home bar are separately provided to different doors, respectively, the number of parts forming a product increase, and a manufacturing time and the number of processes increase.

DISCLOSURE OF INVENTION

Technical Problem

Embodiments provide a refrigerator that can add more functions to a predetermined height of a refrigerator door.

Embodiments also provide a refrigerator including a dispenser and a home bar simultaneously provided to one door. Embodiments also provide a refrigerator including a dispenser and a home bar in a simpler configuration.

Embodiments also provide a refrigerator configured to meet various demands of a consumer.

Embodiments also provide a refrigerator configured to minimize contamination of a water supplying port for supplying water to the outside.

Technical Solution

In one embodiment, a refrigerator includes: a door for opening/closing a storage room of a main body; an openable home bar at the door; and a dispenser at the home bar.

In another embodiment, a refrigerator includes: a door for opening/closing a storage room of a main body; an openable home bar at the door; and a dispenser at the home bar, the dispenser supplying water or ice during only one state of a closed state and an opened state of the home bar.

In further another embodiment, a method for controlling a refrigerator, the method includes: supplying, at a dispenser, one of water and ice during only one of an opened state and a closed state of the home bar when an operation of the dispenser is selected.

The dispenser may be disposed such that it is exposed to an outside of the home bar.

The dispenser may be disposed such that it is shielded from an outside when the home bar is closed.

The dispenser may include: a discharge portion connected to one of a water tank and an ice making unit; and a lever at the home bar, the lever controlling the discharge portion to be opened/closed.

A portion of the discharge portion and the lever may be exposed to an outside.

The refrigerator may further include an opening/closing unit connected to an end of the discharge portion.

The opening/closing unit may include: a holder member communicating with the discharge portion; and an opening/closing member for opening/closing the discharge portion, the opening/closing member being rotatably installed in the holder member.

The discharge portion may include: a discharge tube connected to one of the water tank and the ice making unit, the discharge tube being disposed at the door; and a connecting tube at the home bar, the connecting tube being connected to the discharge tube when the home bar is closed.

The discharge tube may include a valve.

The refrigerator may further include an open/closure detecting unit for detecting opening/closing of the home bar.

Advantageous Effects

According to an embodiment, since a dispenser is disposed at a home bar, more functions can be added to a predetermined height of a door in a concentrated manner. Furthermore, a refrigerator that can realize a composite function to meet various demands of a consumer can be manufactured.

According to another embodiment, since both a dispenser function and a home bar function can be added to one door, a product can be more simplified, and the number of manufacturing processes of the product and manufacturing costs can be reduced.

According to an embodiment, since a water supplying port is not exposed to the front side depending on whether a dispenser is used, the dispenser can be more cleanly used.

MODE FOR THE INVENTION

Reference will now be made in detail to the embodiments of the present disclosure, examples of which are illustrated in the accompanying drawings. However, the sprit of the present disclosure is not limited to the embodiments, and other embodiments, which fall within the scope of the present disclosure, can be easily proposed by adding, modifying, and deleting other elements.

Figure 1:
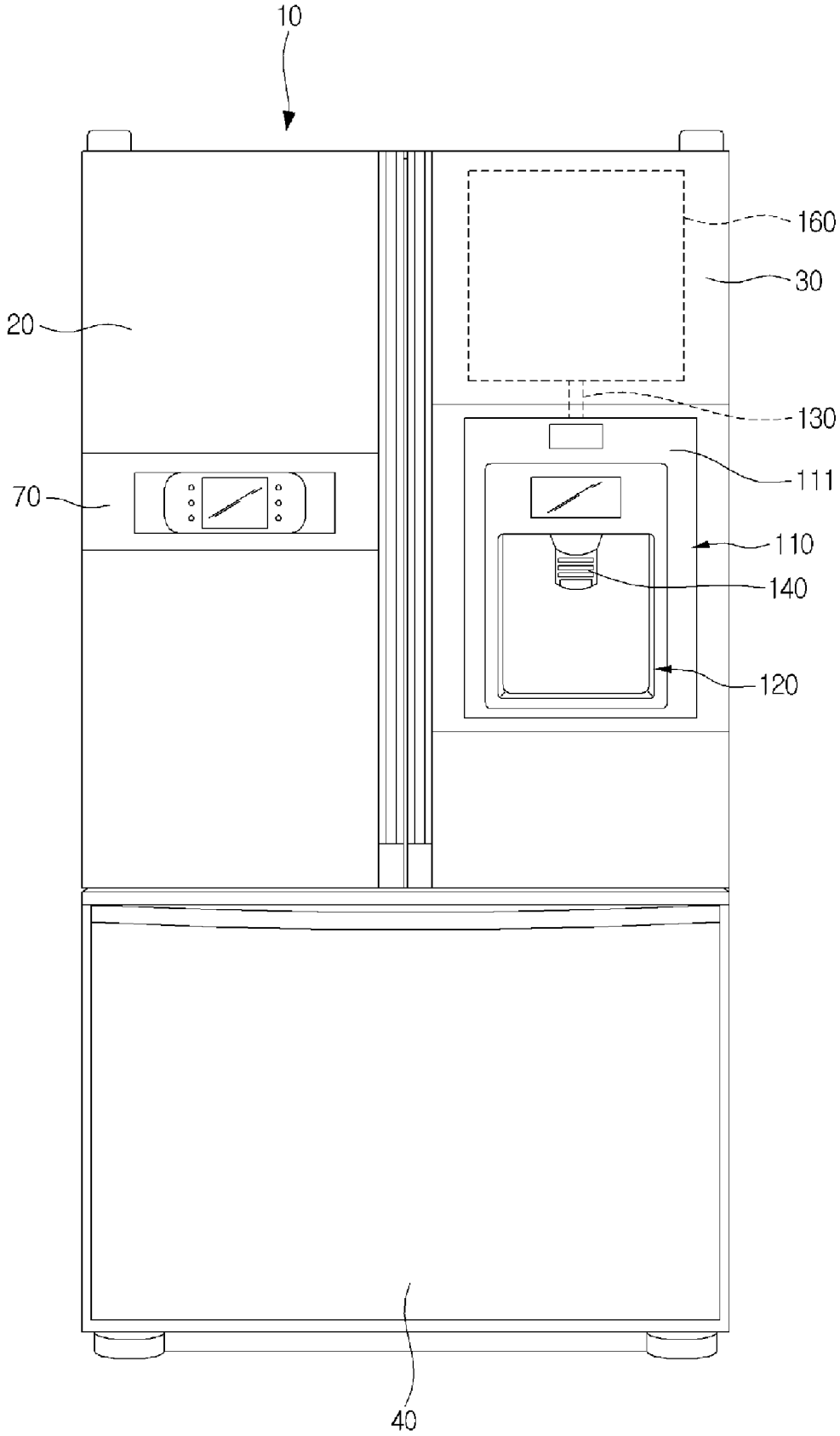
FIG. 1 is a front view illustrating an embodiment of a refrigerator according to an embodiment.

FIG. 1 is a front view illustrating an embodiment of a refrigerator according to an embodiment.

Referring to FIG. 1, a pair of cooling chamber doors 20 and 30, and one freezing chamber door 40 are vertically provided to a refrigerator main body 10. The cooling chamber doors 20 and 30, and the freezing chamber door 40 selectively open/close the cooling chambers (not shown) and the freezing chamber (not shown) provided inside the main body 10 and vertically divided. Each of the cooling chamber doors 20 and 30 includes a front end so installed as to be rotatable back and forth of the main body 10 around its one end. The freezing chamber door 40 drawably moves to back and forth of the main body 10 to selectively open/close the freezing room.

A home bar 110 is provided to the front side of one of the cooling chamber doors 20 and 30. The home bar 110 is designed for taking out/receiving food, for example, drinking water stored in the cooling chamber without opening the door 30.

Also, a dispenser 120 is provided to the front side of the home bar 110. The dispenser 120 is designed for taking out water or ice to the outside without opening the door 30. Since the home bar 110 and the dispenser 120 are installed together at the cooling chamber door 30, a display unit 70 can be additionally installed at the other cooling chamber door 20. Reference numerals 140, 130, and 160 denote a lever, a discharge portion, and a water tank.

Figure 2:
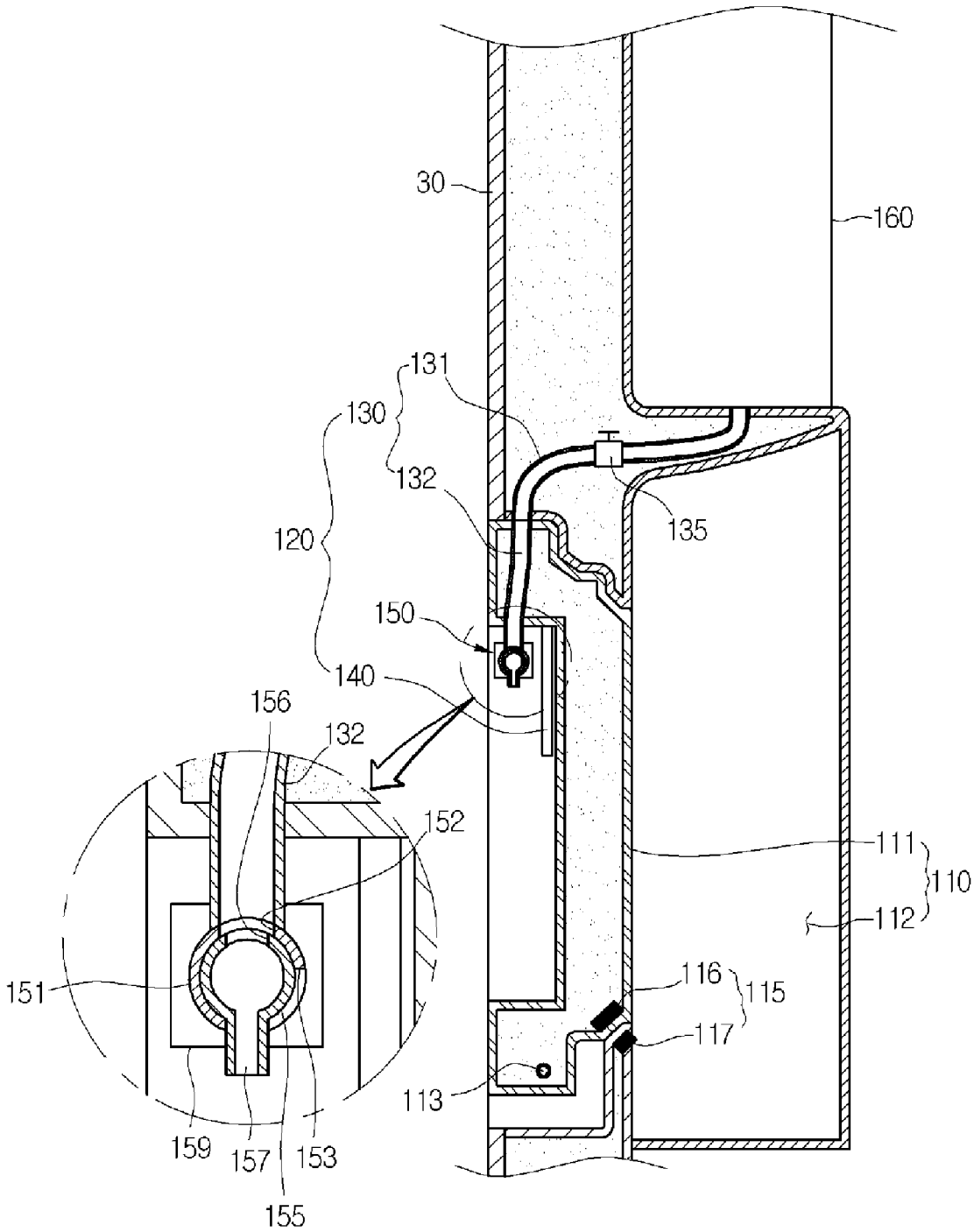
FIG. 2 is a schematic side cross-sectional view illustrating the embodiment of FIG. 1.

FIG. 2 is a schematic side cross-sectional view illustrating the embodiment of FIG. 1.

Referring to FIG. 2, the home bar 110 includes a home bar door 111 openably disposed in the front side of the door 30, and a home bar space 112 formed in the rear side of the home bar door 111. The home bar door 111 is designed for selectively opening/closing the home bar 110. The home bar door 111 is installed in the front side of the door 30 such that its upper end is vertically rotatable around a hinge axis 113 provided at the lower ends on both sides of the home bar door 111.

Also, an open/closure detecting unit 115 is disposed at the home bar 110 to detect opening/closing states of the home bar 110. The open/closure detecting unit 115 can include a magnet 116 and a Hall sensor 117. At this point, the magnet 116 is disposed at the lower portion of the home bar door 111, and the Hall sensor 117 is disposed at a position corresponding to the magnet 116 when the home bar door 111 is closed. When the magnet is detected, the Hall sensor 117 delivers corresponding data to a control unit. A variety of sensors such as a pressure sensor can be used as the open/closure detecting unit 115.

The dispenser 120 includes a discharge portion 130 connected to a water tank 160, and a lever 140 disposed at the home bar 110. The lever 140 allows water to be drained through the discharge portion 130 while a user presses the lever with a cup, for example.

A portion of the discharge portion 130 and the lever 140 can be exposed to the outside. At this point, the portion of the discharge portion 130 and the lever 140 are disposed at the upper portion of the home bar door 111. Therefore, the user can press the lever 140 from the outside to drain water without opening the door.

The discharge portion 130 includes a discharge tube 131 disposed at the door 30, and a connecting tube 132 disposed at the home bar 110. At this point, the discharge tube 131 includes one end connected to the water tank 160, and the other end corresponding to the upper end of the home bar door 111. Also, the connecting tube 132 is connected to the discharge tube 131 when the home bar door 111 is closed.

Also, a valve 135 can be disposed at the discharge tube 131. At this point, the valve 135 can be controlled to be opened/closed only when the home bar 110 is closed. Therefore, when the home bar 110 is opened, the valve 135 is not opened even though the lever 140 is pressed. Accordingly, it is possible to prevent water of the water tank 160 from being drained to the outside when the home bar 110 is opened. The valve 135 can be disposed at a portion where the discharge tube 131 and the water tank 160 are connected.

The refrigerator may further include an opening/closing unit 155 connected to the end of the discharge portion 130. The opening/closing unit 155 includes a holder member 151 disposed at the upper portion of the home bar door 111, and an opening/closing member 155 rotatably installed at the holder member 151. At this point, the holder member 151 is coupled to the end of the connecting tube 132.

The holder member 151 is formed in a cylindrical shape having a predetermined diameter. A communication opening 152 is formed in one side of the outer periphery of the holder member 151. The communication opening 152 is a portion substantially communicating with the connecting tube 132 with the holder member 151 connected to the lower end of the connecting tube 132. A guide slot 153 is provided on the outer periphery of the holder member 151 that faces the inner surface of the dispenser 120. The guide slot 153 is formed by cutting a portion of the outer periphery of the holder member 151 in a back and fourth direction.

The opening/closing member 155 is formed in a cylindrical shape such that its outer periphery is closely attached on the inner periphery of the holder member 151. An introducing opening 156 is formed in one side of the opening/closing member 155. The introducing opening 156 is formed by cutting a portion of the outer periphery of the opening/closing member 155, and selectively communicates with the communicating opening 152 by rotation of the opening/closing member 155 with respect to the holder member 151. Also, the opening/closing member 155 is provided with a drain portion 157 at the opposite side of the introducing opening 156. The drain portion 157 passes through the guide slot 153 to protrude to the outside. The drain portion 157 slides along the guide slot 153 when the opening/closing member 155 rotates with respect to the holder member 151.

The opening/closing member 155 can be configured to be rotated by driving force of a motor 159. For example, when the user presses the lever 140, the motor 159 can be driven to rotate the opening/closing member 155 with respect to the holder member 151. Also, the user can directly rotate the opening/closing member 155 with his hands.

The drain portion 157 is rotated to face the home bar door 111 by driving of the motor 159 while the lever 140 of the dispenser 120 is not pressed. Therefore, contamination of the drain portion 157 by dusts can be minimized.

Also, the water tank 160 is provided to the rear side of the door 30. Water that is to be taken out to the outside through the opening/closing unit 155 is stored inside the water tank 160. The water tank 160 is provided to the rear side of the door 30 that corresponds to the upper portion of the opening/closing unit 155.

The operation of a refrigerator will be described below in detail according to a preferred embodiment.

The home bar door 111 is rotated downward around a hinge shaft 113 to open a home bar space 112. Also, food received inside the home bar 110 is taken out, or food is received in the home bar space 112. When the takeout or reception of food is completed, the home bar door 111 is rotated around the hinge shaft 113 to shield the home bar space 112.

Also, the open/closure detecting unit 115 detects opening/closing of the home bar door 111 that rotates while the home bar 110 is opened/closed. Also, when an opening state of the home bar door 111 is detected by the open/closure detecting unit 115, the valve 135 for supplying water to the dispenser 120 does not operate and maintains a closed state. Accordingly, when the home bar door 111 is opened to take out food received in the home bar space 112 or receive food inside the home bar space 112, water is not supplied to the dispenser 120 even though the user operates the lever 140.

The user operates the lever 140 using a cup while the home bar door 111 is closed, that is, the home bar 110 is shielded. At this point, the valve 135 operates to allow water stored in the water tank 160 to be drained to the outside through the opening/closing unit 155. At this point, since the drain portion 157 of the opening/closing unit 155 is vertically located to face downward, the drain portion 157 is exposed to the front of the dispenser 120 and contaminated by dusts. Therefore, while the dispenser 120 is not used, the opening/closing member 155 is rotated by the motor 156, so that the drain portion 157 faces the home bar door 111 and is not exposed to the outside.

Since the home bar 110 and the dispenser 120 are coupled to each other, a home bar function and a dispenser function can be added to a position where the home bar is installed. Therefore, both the home bar and the dispenser can be installed to one door 30. Also, a display unit 70 can be further installed to the other cooling chamber door 20.

Next, a refrigerator will be described below in more detail according to another embodiment with reference to the accompanying drawings.

Figure 3:
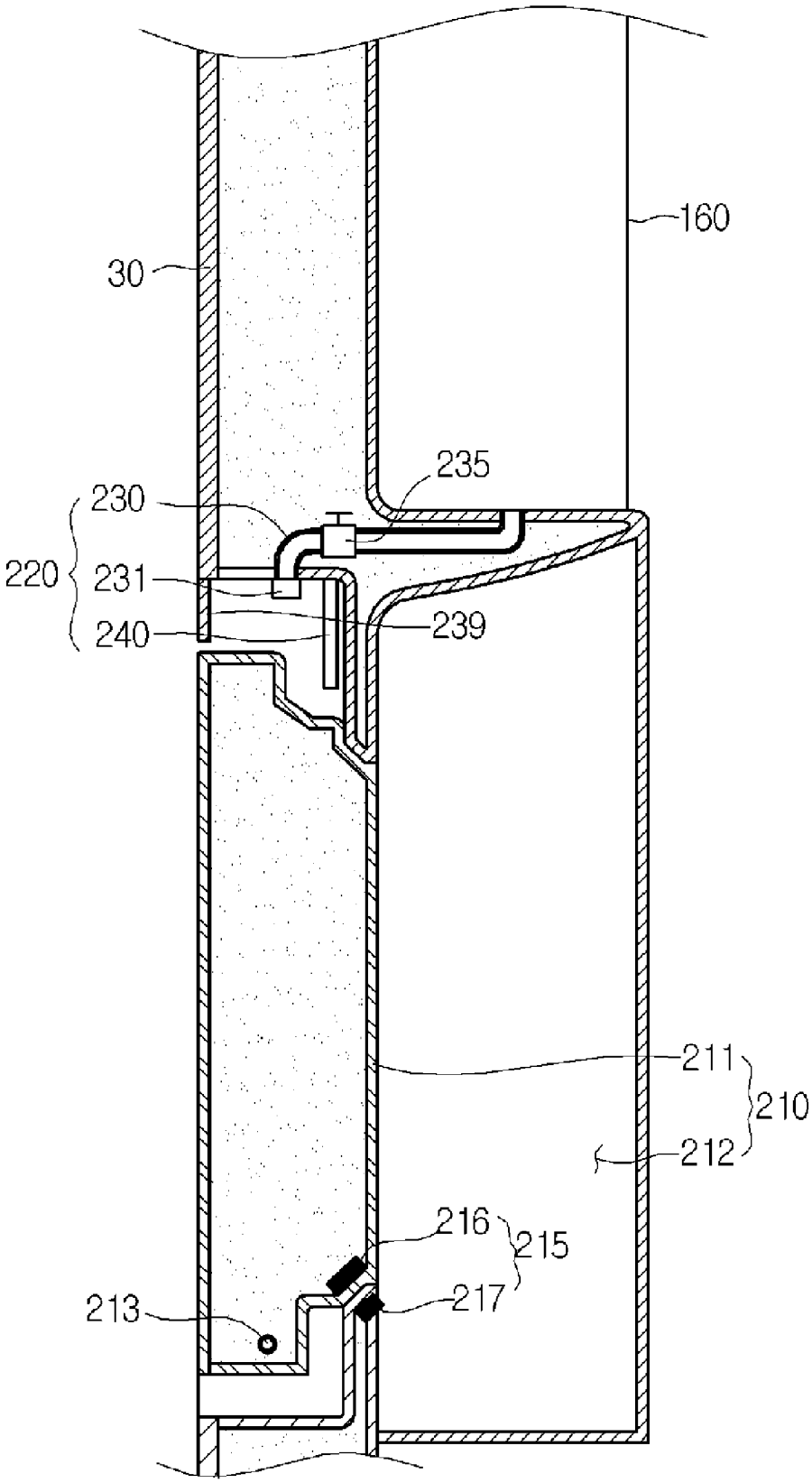
FIG. 3 is a schematic side cross-sectional view illustrating a refrigerator according to another embodiment.

FIG. 3 is a schematic side cross-sectional view illustrating a refrigerator according to another embodiment.

Referring to FIG. 3, a home bar 210 is provided to the front one side of a refrigerator door 30. The home bar 210 can include a home bar door 211 openable in the front side of the door 30, and a home bar space 212 formed in the rear side of the home bar door 211.

The home bar 210 can be selectively opened/closed by the home bar door 211. The home bar door 211 is installed in the door 30 such that its upper end is vertically rotatable around a hinge axis 213 provided at the lower ends of the home bar door 211.

Also, an open/closure detecting unit 215 is disposed at the home bar 210 to detect opening/closing states of the home bar door 211. The open/closure detecting unit 215 can include a magnet 216 and a Hall sensor 217. At this point, the magnet 216 is disposed at the lower portion of the home bar door 211, and the Hall sensor 217 is disposed at a position corresponding to the magnet 216 when the home bar door 211 is closed. When the magnet 216 is detected, the Hall sensor 217 delivers corresponding data to a control unit. A variety of sensors such as a pressure sensor can be used as the open/closure detecting unit 215.

The dispenser 220 includes a discharge portion 230 connected to a water tank 160, and a lever 240 disposed at the upper portion of the home bar 210. The lever 240 allows water to be drained through the discharge portion 230 while a user presses the lever with a cup, for example.

A valve 235 can be disposed to the discharge portion 230. The valve 235 can be controlled to be opened only while the home bar door 211 is opened.

At this point, a dispenser 220 is disposed in a space adjacent to the upper portion of the home bar door 211. The dispenser 220 is designed for taking out water to the outside without opening the door 30.

The dispenser 220 is shielded from the outside while the home bar door 211 is closed. At this point, a shielding member 239 is disposed in front of the discharge portion 230 and the lever 240.

The lever 240 is exposed to the front of the door 30 while the home bar 210 is opened by the home bar door 211. The discharge portion 230 is not exposed to the front of the door 30 while the home bar door 211 is closed. This is for minimizing contamination of the discharge portion 230 by foreign substances such as dusts. Shielding of the discharge portion 230 is performed by the shielding member 239. The shielding member 239 extends downward by a predetermined length from the front end of a ceiling of the dispenser 220 that corresponds to the front of the discharge portion 230. At this point, the lower end of the shielding member 239 is positioned adjacent to the upper side of the home bar door 211 with the home bar door 210 shielded by the home bar door 211.

Also, the water tank 160 is provided in the rear of the door 30 that corresponds to a space above the discharge portion 230. Water taken out to the outside through the discharge portion 230 is stored inside the water tank 160. The water stored in the water tank 160 is supplied to the dispenser 220 through the discharge portion 230. Both ends of the discharge portion 230 are connected to a discharge port 231 and the water tank 160, respectively.

The operation of a refrigerator will be described below in detail according to another embodiment.

The home bar door 211 is rotated downward around the hinge shaft 213 to open/close the home bar 210, and then receive and/or take out food in/from the home bar space 212.

To use the dispenser 220, the home bar door 211 is rotated around the hinge shaft 213 to open the home bar 210. When a user operates the lever 240 using a cup with this state, the valve 235 is opened, so that water stored in the water tank 160 is drained to the outside through the discharge portion 230. At this point, since the discharge portion 230 is shielded at the front of the door 30 by the shielding member 239, contamination of the discharge portion 230 by foreign substances such as dusts is minimized.

Next, a refrigerator will be described below in more detail according to further another embodiment with reference to the accompanying drawings.

Figure 4:
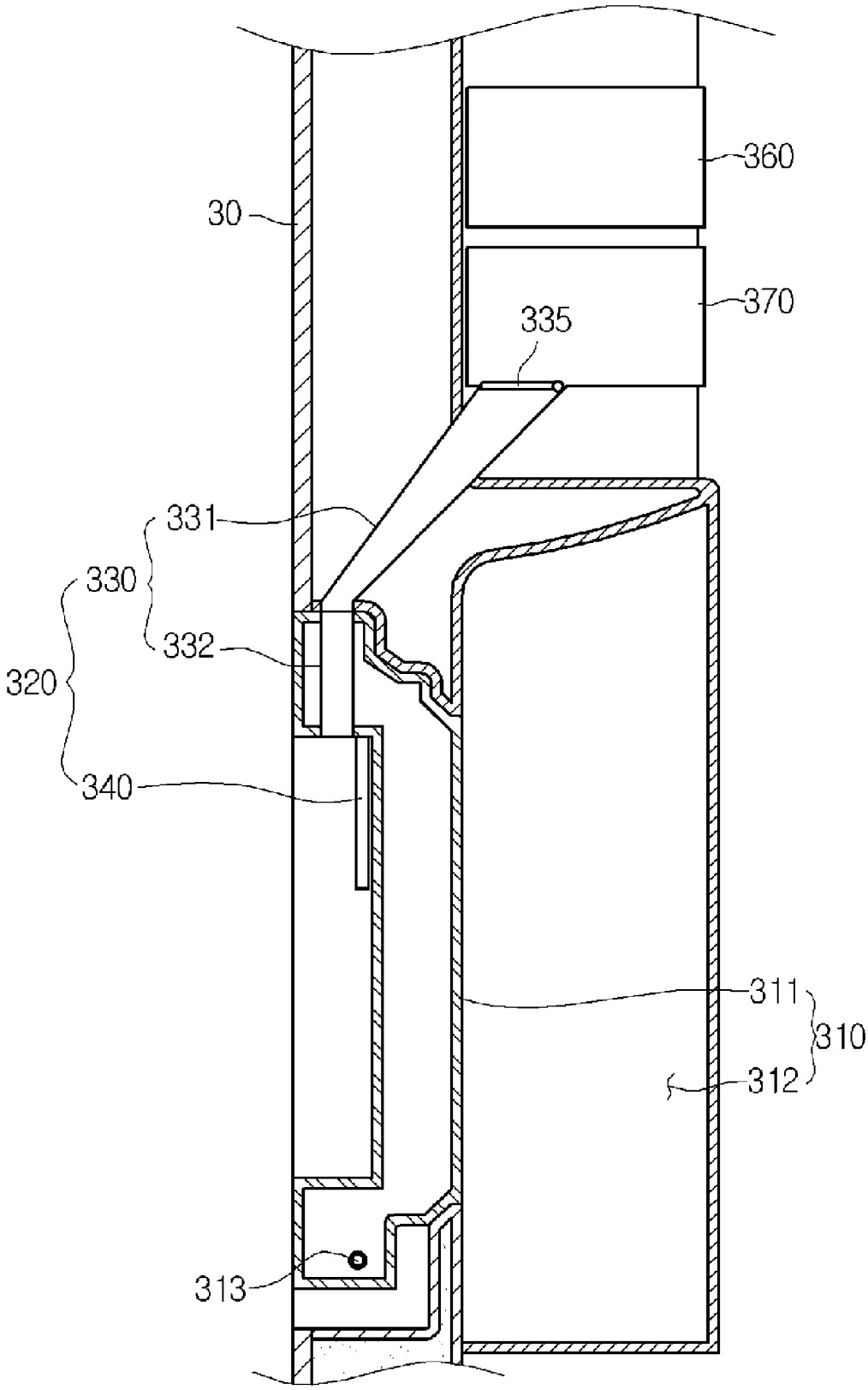
FIG. 4 is a schematic side cross-sectional view illustrating a refrigerator according to further another embodiment.

FIG. 4 is a schematic side cross-sectional view illustrating a refrigerator according to further another embodiment.

Referring to FIG. 4, a home bar 310 is provided to the front one side of a refrigerator door 30. The home bar 310 can include a home bar door 311 openable in the front side of the door 30, and a home bar space 312 formed in the rear side of the home bar door 311.

The home bar 310 can be selectively opened/closed by the home bar door 311. The home bar door 311 is installed in the door 30 such that its upper end is vertically rotatable around a hinge axis 313 provided at the lower ends of the home bar door 311.

Also, an open/closure detecting unit 315 is disposed at the home bar 310 to detect opening/closing states of the home bar door 311. The open/closure detecting unit 315 can include a magnet 316 and a Hall sensor 317. At this point, the magnet 316 is disposed at the lower portion of the home bar door 311, and the Hall sensor 317 is disposed at a position corresponding to the magnet 316 when the home bar door 311 is closed. When the magnet 316 is detected, the Hall sensor 317 delivers corresponding data to a control unit. A variety of sensors such as a pressure sensor can be used as the open/closure detecting unit 315.

The dispenser 320 includes a discharge portion 330 connected to ice making units 360 and 370 and a lever 340 disposed at the upper portion of the home bar 310. The lever 340 allows ice to be supplied through the discharge portion 330 while a user presses the lever with a cup, for example. At this point, only the lever 340 of elements forming the dispenser 320 is exposed to the front.

The discharge portion 330 includes a discharge tube 331 disposed at the door 30 and a connecting tube 332 disposed at the home bar door 311. The connecting tube 332 is connected to the discharge tube 331 when the home bar door 311 is closed. At this point, the discharge tube 331 and the connecting tube 332 serve as passages for guiding ice so that the ice is discharged.

A valve 335 can be disposed to the discharge portion 330. The valve 335 can be controlled to be opened only while the home bar door 311 is closed.

An ice bank 370 is disposed in the rear of the door 30 that corresponds to a space above the discharge portion 330. An ice maker 360 for making ice and discharging the ice to the ice bank 370 is disposed above the ice bank 370. The ice bank 370 and the ice maker 360 form an ice making unit. Descriptions of the structures of the ice maker 360 and the ice bank are omitted.

The operation of the refrigerator will be described below in more detail according to further another embodiment.

When ice is made at the ice maker 360, the ice maker 360 discharges the ice to the ice bank 370. At this point, the ice maker 360 continuously makes ice and discharges the ice downward until a predetermined amount of ice is received in the ice bank 370. Therefore, the ice bank 370 always stores the predetermined amount of ice.

Meanwhile, the home bar door 311 is rotated downward around the hinge shaft 313 to open/close the home bar 310, and then receive and/or take out food in/from the home bar space 312.

To use the dispenser 320, the home bar door 311 is rotated around the hinge shaft 313 to close the home bar 310. When a user operates the lever 340 using a cup with the home bar door 311 closed, the valve 335 is opened, so that ice stored in the ice bank 370 is discharged to the outside through the discharge portion 330.

As described above, a home bar function and a dispenser function are integrated in a position where the home bar 310 is installed by coupling the home bar 310 to the dispenser 320 for discharging ice. Therefore, both the home bar 310 and the dispenser 320 can be installed in one door 30.

INDUSTRIAL APPLICABILITY

Since the above-described refrigerator can integrate various functions in one door by disposing the dispenser at the home bar, the refrigerator has remarkable industrial applicability.

The invention claimed is:

1. A refrigerator comprising: a storage room defined in a main body; a storage room door that opens or closes the storage room; an openable home bar at the storage room door; a home bar door hingedly attached at a bottom end thereof to the storage room door to open/close a front opening of the home bar; and a dispenser, at least a portion of the dispenser being exposed to an outside of the home bar door, the dispenser including: a supply passage provided at the storage room door and the home bar door to supply water or ice, the supply passage being connected to one of a water tank and an ice making unit; and a lever at the home bar door, the lever controlling the supply passage to be opened/closed, wherein a portion of the supply passage and the lever are exposed to an outside of the home bar door, and wherein the dispenser supplies water or ice during only one state of a closed state and an open state of the home bar door.

2. The refrigerator according to claim 1, further comprising an opening/closing unit connected to an end of the supply passage.

3. The refrigerator according to claim 2, wherein the opening/closing unit comprises:

a holder member communicating with the supply passage; and an opening/closing member for opening/closing the supply passage, the opening/closing member being rotatably installed in the holder member.

4. The refrigerator according to claim 2, wherein the supply passage comprises: a discharge tube connected to one of the water tank and the ice making unit, the discharge tube being disposed at the storage room door; and a connecting tube at the home bar door, the connecting tube being connected to the discharge tube while the home bar door is closed.

5. The refrigerator according to claim 4, wherein the discharge tube comprises a valve.

6. The refrigerator according to claim 1, further comprising an open/closure detecting unit for detecting opening/closing of the home bar door.

* * * * *